US005321892A

United States Patent [19]

Sasada

[11] Patent Number: 5,321,892

[45] Date of Patent: Jun. 21, 1994

[54] AUTOMATIC PAPER-CUTTING DEVICE IN PLOTTER

[75] Inventor: Hiroyasu Sasada, Tokyo, Japan

[73] Assignee: Mutoh Industries Ltd., Tokyo, Japan

[21] Appl. No.: 964,957

[22] Filed: Oct. 22, 1992

[30] Foreign Application Priority Data

Nov. 26, 1991 [JP] Japan ..... 3-104753[U]

[51] Int. Cl.[5] ..... B26D 1/04

[52] U.S. Cl. ..... 33/18.1; 33/32.3; 83/614

[58] Field of Search ..... 33/18.1, 18.2, 32.1, 33/32.3, 32.4, 32.5, 32.6, 32.7; 83/614, 508, 382, 454; 395/103

[56] References Cited

U.S. PATENT DOCUMENTS

| | | | |
|---|---|---|---|
| 1,853,498 | 4/1932 | Bliven | 33/32.4 |
| 3,130,499 | 4/1964 | Hanneken et al. | 33/18.1 |
| 3,548,502 | 12/1970 | Baldwin | 33/18.1 |
| 4,152,962 | 5/1979 | Hendrischk | 83/614 |
| 5,036,740 | 8/1991 | Tsai | 83/614 |
| 5,146,823 | 9/1992 | Holmes | 83/614 |

*Primary Examiner*—William A. Cuchlinski, Jr.
*Assistant Examiner*—C. W. Fulton
*Attorney, Agent, or Firm*—Sughrue, Mion, Zinn, Macpeak & Seas

[57] ABSTRACT

An object of this invention is to improve the sharpness of cutting and to prolong the longevity of the blade by increasing the cutting speed with a rotation of the round blade cutter that is more than the normal rotation of 1:1.

The base 34 is linked with the drawing head 8 by means of the detachable hook 16 and the hook receiver 32, and when the base 34 moves along the rail 6 with the drawing head 8, the rubber roller 46 rotates with the friction with the paper-mounting plate 2. The rotation of the rubber roller 46 is transmitted to the round blade cutter 40 by means of the speed increasing mechanism, and the round blade cutter 40 rotates at a high speed in the same direction with the rubber roller 46 and moves along the cutter groove 4 to cut the paper 12.

5 Claims, 3 Drawing Sheets

AUTOMATIC PAPER-CUTTING DEVICE IN PLOTTER

DESCRIPTION OF THE PRIOR ART

In the specification and drawings of Japanese Utility Model Laid-open Publication No. Sho 62-178194, a cutting device is disclosed in which a pen carriage and a cutter proper are engaged, and while the cutter proper shifts in a paper-cutting direction by the drive of the pen carriage, the paper on a paper-mounting plate is automatically cut with the cutting blade of the cutter.

Also, a cutting device is used in which a round blade interlockingly rotates at a speed ratio of 1:1 with respect to a roller rotating on a paper-mounting plate and the paper on the paper-mounting plate is cut with the round blade.

SUMMARY OF THE INVENTION

This invention relates to an automatic paper-cutting device in a plotter. When the paper on a paper-mounting plate is cut, the paper is not cut accurately and smoothly unless the cutting edge rotates at a high speed. However, conventional devices were not able to cut the paper smoothly due to the fact that the cutting edge was not rotated or the rotating speed was slow. An object of this invention is to solve the foregoing problems.

In order to achieve the foregoing object, this invention improves the cutting speed by making the rotation of the round blade cutter faster than the normal rotation speed ratio of 1:1. This invention also enhances the sharpness of the cutting by decreasing the linear extent of the cut mode by one rotation of the cutter and prolongs the longevity of the blade.

In this invention, the base of the cutting device supporting the round blade cutter is supported on the rail which is mounted on the paper-cutting plate to be shiftable along the rail. The base is linked with a drawing line head by means of a detachable hook and a hook receiver, and the base is moved along the rail with the drawing line head. A rubber roller supported on the base is rotated by the friction with the paper-mounting plate. The rotation of the rubber roller is transmitted to the round blade cutter by means of a speed increasing mechanism. The round cutter is transferred along a cutter groove of the paper-mounting plate by rotating at a high speed in a direction identical with that of the rubber roller, and cuts the paper on the paper-mounting plate. The diameter of the rubber roller is made smaller than the diameter of the round blade cutter.

As described in the foregoing, this invention increases the cutting speed by elevating the revolutions of the round blade cutter with the speed increasing mechanism. Also, there is the effect the cutting sharpness of the round blade cutter and its longevity can be improved by decreasing the linear extent of the cut made by one rotation of the round blade cutter.

DETAILED DESCRIPTION OF THE PREFERRED EMBODIMENT

Figure 1:
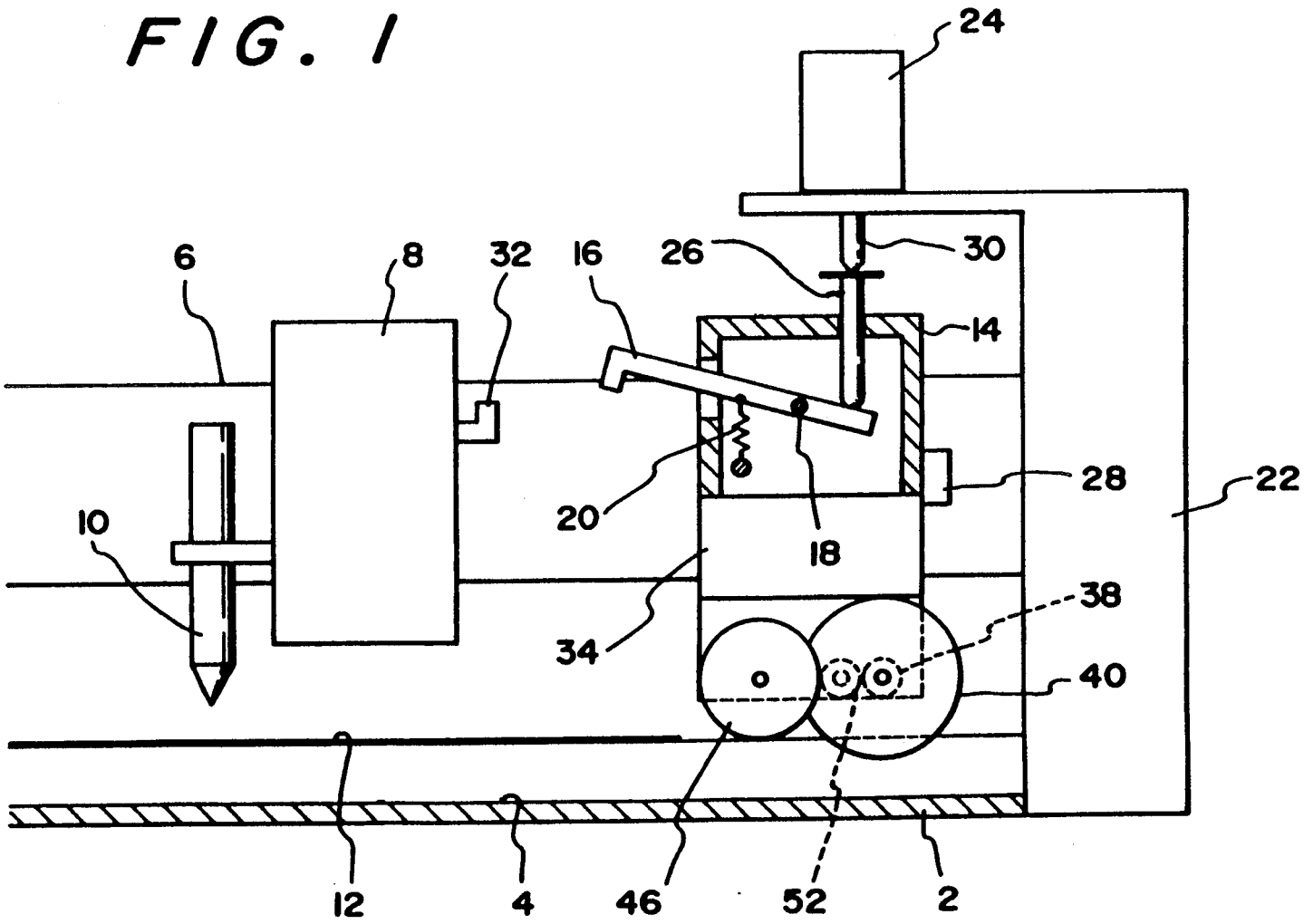
FIG. 1 is an elevation showing an automatic paper-cutting device for a plotter embodying this invention.
Figure 2:
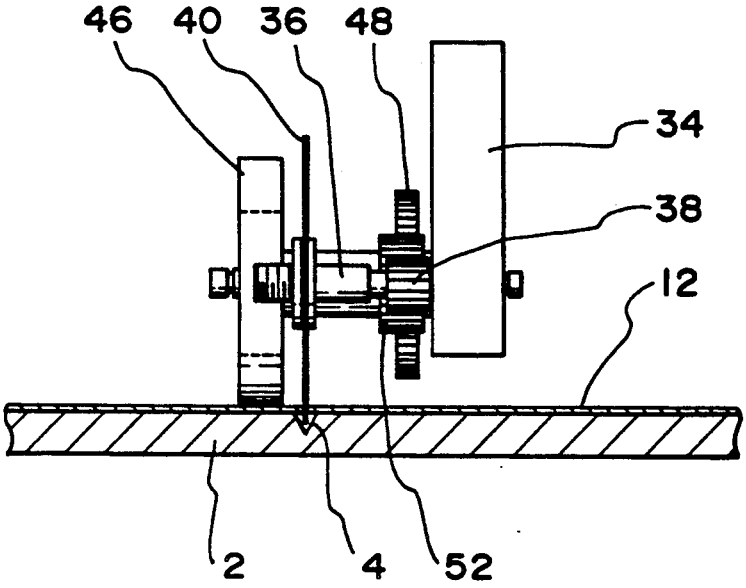
FIG. 2 is a side view of the automatic paper-cutting device for a plotter embodying this invention.
Figure 3:
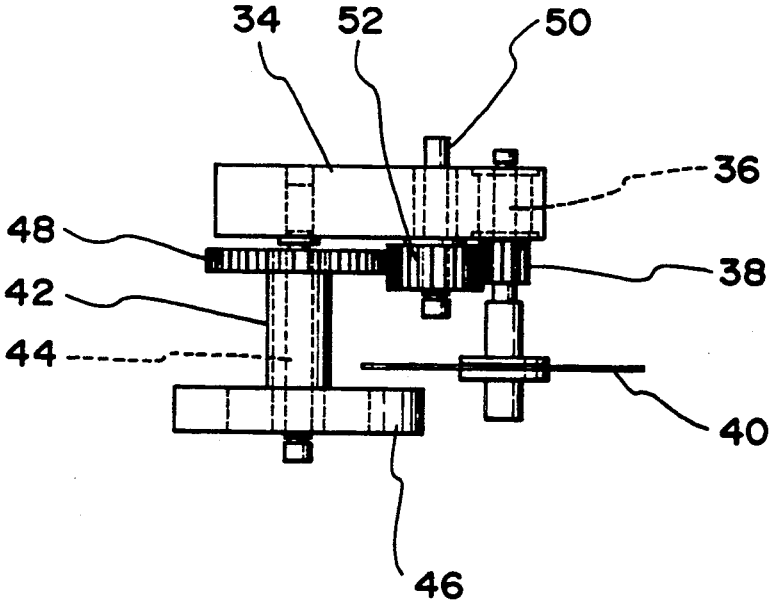
FIG. 3 is a plan of the automatic paper-cutting device for a plotter embodying this invention.
Figure 4:
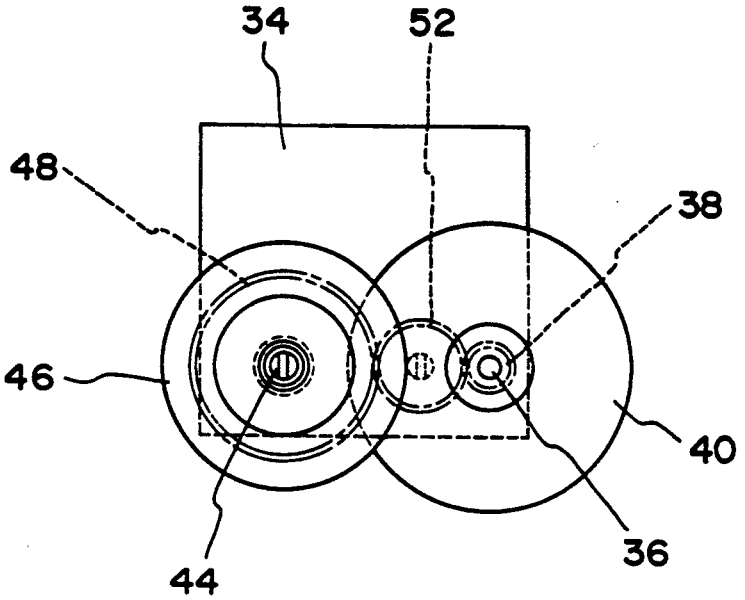
FIG. 4 is an elevation showing another embodiment of the automatic paper-cutting device embodying this invention.

The construction of this invention will be described in detail in the following by referring to an embodiment shown in the attached drawings.

Reference numeral 2 denotes a paper-mounting plate which is affixed to the machine body of a plotter. On the paper-mounting plate 2, a cutter groove 4 is engraved along a Y-axis direction. A Y rail 6 is mounted onto the machine body which is positioned parallel to the upper part of the paper-mounting plate 2.

On the Y rail 6, a drawing line head 8 is shiftably mounted. The drawing line head 8 is engaged with a known Y-axis drive system, and the movement of the drawing line head 8 to the right and left, is controlled by a controller along the Y rail 6, in FIG. 1, namely, along the Y rail 6 in a Y-axis direction.

The drawing line head 8 contains a pen holder which is connected to a lifting drive device which is built into the drawing line head 8, and a pen 10 which is detachably held on a pen holder. On the paper-mounting plate 2, a drawing roller and a drive roller are mounted, and the drive roller is placed opposite the pressure roller (not shown). In the drawing, a paper 12 on the mounting plate 2 is sandwiched by the drive roller and the pressure roller, and is moved in a perpendicular direction (X-axis direction) in the drawing on the mounting plate 2 by normal or reverse rotation of the drive roller. On the other hand, while the pen 10 is controlled by lifting it or advancing it against the paper 12 on the drawing roller, the pen is moved (in a Y-axis direction) across the paper 12 along the Y rail 6. A predetermined drawing is drawn on the paper 12 by the pen 10, as the paper is fed through.

Reference numeral 14 denotes the casing of a cutting unit, which is mounted onto the Y rail 6 shiftably. A detachable hook 16 is swivellably journalled on the casing 14, and the hook is energized in a direction where a hooking edge portion swivels in a downward direction by the tensile strength of a spring 20. Reference numeral 22 denotes a bracket erected at one side of the mounting plate 2, and a solenoid 24 is affixed to a horizontal plate on the bracket.

A pin 26 is liftably supported on the casing 14, and the lower end of the pin 26 is placed near the other end of the hook 16. In the condition where the cutting unit shifts to a predetermined standby position and engages with a stopper 28 near the end portion of the Y rail 6, the pin 26 is set to be positioned Just below the output shaft 30 of the solenoid 24. On the head 8, a detachable hook receiver 32 is affixed opposite to the hook 16.

Reference numeral 34 denotes a base affixed to the casing 14, and a shaft 36 is rotatably journalled on the base by means of a bearing. A pinion 38 and a round blade cutter 40 are affixed to the shaft 36. Reference numeral 42 denotes a tubular member which is rotatably fitted to a shaft 44 which is affixed to the base 34, and a rubber roller 46 is affixed to a flange portion that is extending from the tubular member. A gear 48 is affixed to the other end of the tubular member 42. Reference numeral 50 denotes a shaft rotatably Journalled on the base 34 by means of a bearing, and an idler gear 52 is affixed to the shaft. The pinion 38 and the gear 48 are meshed with the idler gear 52.

The gear 48, idler gear 52 and pinion 38 constitutes a speed increasing mechanism for increasing the speed of the rubber roller 46 which transmits the rotation to the round blade cutter 40. The lower part of the round blade cutter 40 is placed in the cutter groove 4. The rubber roller 46 is in pressure contact on the mounting plate next to the cutter groove 4.

In the foregoing construction, when the drawing on the paper 12 is completed, the paper 12 is transferred by the drive roller, and the portion of the paper 12 to be cut is placed on the cutter groove 4.

Next, the head 8 is moved to the end of the Y rail 6, the solenoid 24 is energized and the detachable hook 16 is swivelled in a clockwise direction in FIG. 1. When the detachable hook receiver 32 is moved to a linking position with the detachable hook 16, the transfer of the head 8 is engaged, and also, the energization to the solenoid 24 is released. The detachable hook 16 is swivelled in an anti-clockwise direction in FIG. 1 by the tensile strength of the spring 20, and the hooking portion of the hook 16 and the hook receiver 32 are linked. Next, when the head 8 is moved to the left in FIG. 1, the cutting unit 14 is interlocked with the head 8, and is also moved along the Y rail 6.

The rubber roller 46 is rotated in an anti-clockwise direction while holding the paper 12 on the mounting plate 2 by moving to the left along the Y rail 6 in FIG. 1 This rotation is transmitted to the round blade cutter 40 by means of the speed increasing mechanism. The round blade cutter 40 cuts the paper 12, following the head 8, while rotating in a direction identical with the rotating direction of the rubber roller 46. The rotating speed of the round blade cutter 40 and the linear extent of the cut per one rotation can be determined by the gear ratio of the gear 48 and the pinion 38 and the ratio of the diameters of the rubber roller 46 and the round blade cutter 40. The bigger the gear ratio of the gear 48 and the pinion 38, the higher the speed of the round blade cutter 40. Also, the bigger the difference in diameters of the rubber roller 46 and the round blade cutter 40, the smaller the linear extent of the cut per rotation of the round blade cutter 40. The round blade cutter 40 turns in a directions pressing down on the paper 12.

Figure 5:
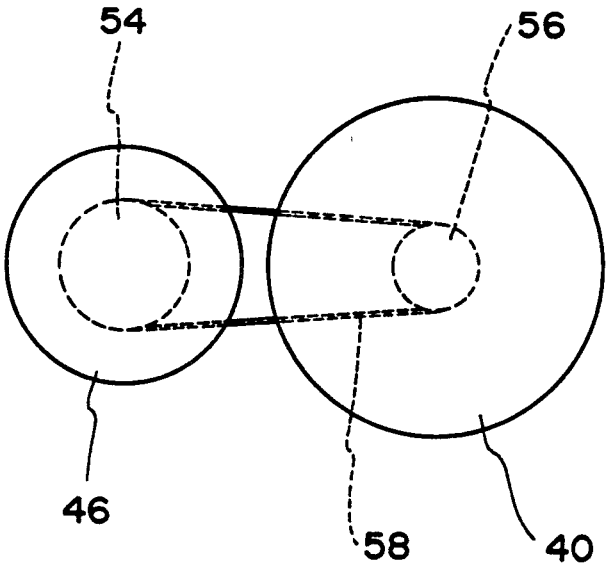
FIG. 5 is an elevation showing another embodiment the automatic paper-cutting device.

In this device, the transfer of the round blade cutter 40 and the transfer of the drawing line head 8 are utilized as the driving source of the rotation, but the drawing line head 8 and the cutting unit may be driven along the Y rail 6 by exclusive driving devices separately. Also, a guiding mechanism especially for the cutting unit, corresponding to the Y rail, may be provided. The speed increasing mechanism is not particularly limited to a construction using the gears. A speed increasing mechanism may also be formed by a belt 58 and pulleys 54 and (FIG. 5). For the plotter, a variety of plotter constructions may be used.

What is claimed is:

1. An automatic paper-cutting device for a plotter, comprising:

a base of a cutting device supported on a machine body of the plotter by a guiding mechanism capable of moving on a paper-mounting plate in a direction parallel to a cutter groove, a lower part of a round blade cutter rotatably supported on the base being inserted into the cutter groove, said round blade cutter being movable along the cutter groove by the movement of the base along the paper-mounting plate said cutting device comprising a roller supported rotatably on the base and which rotates in a predetermined direction, said roller being driven by frictional contact with the paper-mounting plate or the paper as the base moves along the cutter groove, and a speed increasing mechanism coupled between said roller and said round blade cutter for driving said round blade cutter in the same direction as said roller, and at a higher rotating speed.

2. An automatic paper-cutting device according to claim 1 in which the roller is a rubber roller.

3. An automatic paper-cutting device according to claim 1 in which the base is driven along the cutter groove by an exclusive driving device.

4. An automatic paper-cutting device according to claim 1 in which the base is connectable with a drawing head, and moves along the cutter groove with the drawing head.

5. An automatic paper-cutting device according to claim 1 in which the diameter of the roller is made smaller than the diameter of the round blade cutter.

* * * * *